US010285480B2

(12) United States Patent
Chovich

(10) Patent No.: US 10,285,480 B2
(45) Date of Patent: May 14, 2019

(54) LOAD CONVEYANCE SYSTEM

(71) Applicant: Miko Chovich, Inver Grove Heights, MN (US)

(72) Inventor: Miko Chovich, Inver Grove Heights, MN (US)

( * ) Notice: Subject to any disclaimer, the term of this patent is extended or adjusted under 35 U.S.C. 154(b) by 150 days.

(21) Appl. No.: 15/634,761

(22) Filed: Jun. 27, 2017

(65) Prior Publication Data

US 2017/0367453 A1 Dec. 28, 2017

Related U.S. Application Data

(60) Provisional application No. 62/355,123, filed on Jun. 27, 2016.

(51) Int. Cl.

| | |
|---|---|
| ***A45C 13/38*** | (2006.01) |
| ***A45F 3/12*** | (2006.01) |
| ***A45F 3/14*** | (2006.01) |
| ***A45C 13/30*** | (2006.01) |

(52) U.S. Cl.

CPC ..... *A45C 13/38* (2013.01); *A45C 13/30* (2013.01); *A45F 3/12* (2013.01); *A45F 3/14* (2013.01); *A45F 2003/142* (2013.01); *A45F 2003/146* (2013.01)

(58) Field of Classification Search

CPC ..... A45F 2003/142; A45F 3/14; A45F 2003/146; A45F 3/12; A45C 13/30; A45C 13/38; A45C 2013/303

USPC ..... 224/257–260, 264, 266; D3/327; 294/152–156

See application file for complete search history.

(56) References Cited

U.S. PATENT DOCUMENTS

| | | | | |
|---|---|---|---|---|
| 5,183,334 | A * | 2/1993 | Geistlinger | B01F 11/0002 294/153 |
| 5,203,482 | A | 4/1993 | Puff | |
| 5,292,044 | A | 3/1994 | Reimers | |
| 5,450,995 | A | 9/1995 | Perrin | |
| 5,507,542 | A * | 4/1996 | Eden | A45F 5/1026 294/143 |
| 5,695,102 | A | 12/1997 | Jackson | |
| 5,950,893 | A | 9/1999 | Heggeland | |
| 6,092,574 | A | 7/2000 | Krulik | |
| 8,302,830 | B1 | 11/2012 | Jensen et al. | |
| 8,899,455 | B2 | 12/2014 | Scicluna | |
| 8,955,197 | B2 | 2/2015 | Bailey | |
| 9,089,188 | B2 | 7/2015 | Wear et al. | |
| 9,545,142 | B2 | 1/2017 | Pitchforth et al. | |
| 9,596,922 | B2 | 3/2017 | Nielsen | |
| 9,635,914 | B2 | 5/2017 | Fujikura | |
| 2002/0008125 | A1 | 1/2002 | Caputi | |
| 2002/0100781 | A1 | 8/2002 | Finkelstein | |
| 2002/0108979 | A1 | 8/2002 | Finkelstein | |
| 2003/0009847 | A1 | 1/2003 | Godshaw et al. | |
| 2003/0135954 | A1 | 7/2003 | Beckwith | |
| 2003/0160078 | A1 | 8/2003 | Godshaw et al. | |
| 2004/0010887 | A1 | 1/2004 | Cohen | |

(Continued)

*Primary Examiner* — Scott T McNurlen

(74) *Attorney, Agent, or Firm* — Mitchell A. Rossman; Terra Nova Patent Law, PLLC

(57) ABSTRACT

The present invention provides a load conveyance system. The load conveyance system includes: an adjustable retaining harness that fits around a user's shoulder and arm; a first shoulder pad that fits on the user's other shoulder; a suspension strap; a handle, and a member. Methods of using the load conveyance system are also disclosed.

13 Claims, 4 Drawing Sheets

(56) References Cited

U.S. PATENT DOCUMENTS

| | | | | |
|---|---|---|---|---|
| 2004/0094586 | A1* | 5/2004 | MacAllister | A45F 3/14 224/258 |
| 2004/0185247 | A1 | 9/2004 | Fenton et al. | |
| 2004/0262358 | A1 | 12/2004 | Meyer | |
| 2005/0103817 | A1 | 5/2005 | Glankler | |
| 2005/0109805 | A1 | 5/2005 | Pratt et al. | |
| 2005/0211740 | A1 | 9/2005 | Sekulic | |
| 2005/0279791 | A1* | 12/2005 | Komorowski | A45C 13/38 224/260 |
| 2006/0289575 | A1 | 12/2006 | Chou | |
| 2007/0245526 | A1 | 10/2007 | Fidrych et al. | |
| 2008/0135364 | A1* | 6/2008 | Chang | A45C 5/06 190/103 |
| 2009/0194568 | A1 | 8/2009 | Fraser | |
| 2009/0283560 | A1 | 11/2009 | Burton et al. | |
| 2010/0288806 | A1 | 11/2010 | Wier | |
| 2011/0272443 | A1 | 11/2011 | Fidrych et al. | |
| 2011/0309123 | A1 | 12/2011 | Ashenafi | |
| 2012/0000947 | A1* | 1/2012 | Ashley | A45F 3/14 224/257 |
| 2012/0048900 | A1 | 3/2012 | Wong | |
| 2013/0097810 | A1 | 4/2013 | Ackerman et al. | |
| 2013/0146629 | A1* | 6/2013 | Glines | A45F 3/14 224/260 |
| 2013/0306504 | A1 | 11/2013 | Wear et al. | |
| 2014/0060713 | A1 | 3/2014 | Barrow, Jr. | |
| 2014/0069977 | A1 | 3/2014 | Liu et al. | |
| 2014/0361059 | A1* | 12/2014 | Fuller, Sr. | A45F 5/00 224/267 |
| 2015/0083766 | A1 | 3/2015 | Scicluna | |
| 2015/0257516 | A1 | 9/2015 | Herron et al. | |
| 2016/0022018 | A1 | 1/2016 | Searle et al. | |
| 2016/0280100 | A1 | 9/2016 | Scheppegrell et al. | |
| 2017/0119121 | A1 | 5/2017 | Munoz | |

* cited by examiner

LOAD CONVEYANCE SYSTEM

RELATED APPLICATIONS

This application claims priority to U.S. Provisional Patent Application Ser. No. 62/355,123 filed Jun. 27, 2016, which is hereby incorporated by reference in its entirety for all purposes.

BACKGROUND OF THE INVENTION

A traveler typically carries their luggage by gripping the luggage by the handle and carrying it with their arm or by placing a shoulder strap attached to the luggage across one shoulder and carrying the luggage by lifting up some of the weight with their arm to reduce the weight on the shoulder. However, unless the traveler is exceptionally strong, the traveler easily tires from carrying their heavy luggage over the long distances, steps, escalators, typically found in airports, train and bus stations, etc. because their hand and arm muscles tire easily and their shoulder gets sore. Moreover, the typical duffel bag straps are made of rigid materials, and thereby allow for the luggage to bounce up and down.

What is needed is a load conveyance system that assists the traveler to carry typical or heavy luggage smoothly and efficiently over long distances. The utility of such a device can be applied to any application or unit with a handle to grasp, such as a medical gurney or military stretcher. Contrary to previous attempts, this system provides greater comfort and safety features not included whatsoever in older systems. Additionally, older systems lack a metered system for the distribution of the carried weight.

SUMMARY OF THE INVENTION

The present invention provides a load conveyance system. The load conveyance system includes: an adjustable retaining harness that fits around a user's shoulder and arm; a first shoulder pad that fits on the user's other shoulder; a suspension strap; a handle, and a member. Methods of using the load conveyance system are also disclosed.

The present invention provides the following advantages: 1. a distribution of weight divided between the user's arm and shoulder for greatest comfort; 2. a metered means to achieve this greatest comfort by distributing a rated weight by means of the stretchable suspension strap to the shoulder and anything in excess by being transferred to the user's grasping arm; 3. the user maintains a grasp on the load to suspend it and what residual weight that is not supported by the shoulder. This is accomplished by grasping the member around the handle of the load, or any appropriate burden with a handle, to allow the user to merely maintain suspension of the load without even flexing the arm, thus reducing their bicep fatigue; 4. additionally, the adjustable retaining harness may be utilized to provide stability to the shoulder pad and carrying assembly from possible lateral forces that may unseat the load conveyance system, such as when the load is a stretcher; 5. the load conveyance system is designed to fail in case of excessive and dangerous forces. Should the load conveyance system somehow be snagged or pulled in there is at least one built in safety point; the adjustable retaining harness has a built in failing point which tears to shed the conveyance assembly from the user thus breaking them free preventing entrapment; 6. this pre-metered elastic lifting feature may also be applied for pulling. One may utilize the load conveyance system to pull or lift objects toward oneself by using one's own strength and preloaded tension on the strap and pulling the object with combined forces toward the user by the same principle. This magnifies the user's pulling power; 7. the ambidextrous capability allows a user to mount the load conveyance system on either shoulder and/or side; 8. additionally two load conveyance systems may also be applied simultaneously coupled by a two-side pierced belt with a break-off feature, in the middle, to multiply capability; 9. the load pick up is instantaneous with the weight having to be encountered instantaneously. Due to the load conveyance system elasticity, the majority of the load's weight is gradually transferred to the user's shoulder through a range of several inches as the user stands up until the load's remaining weight is taken by the grasping arm and then suspended; 10. the elastic ability provides vertical and horizontal stability and shock absorption; 11. the load conveyance system magnifies physical abilities to convey burdens by people of smaller statures and weaker physical strength, and 12. the quick release ability. In any emergency, the operator merely releases their grip on the handle to release the load.

The present invention provides a load conveyance system. The load conveyance system includes: an adjustable retaining harness having a proximal end and a distal end, wherein the proximal end of the adjustable retaining harness is configured to wrap around a first shoulder and a first arm pit of a user; a first shoulder pad having a first surface, a second surface, a proximal end, and a distal end, wherein the first surface of the first shoulder pad is coupled with the distal end of the adjustable retaining harness; a suspension strap having a proximal end and a distal end, wherein the suspension strap is coupled with the first surface of the first shoulder pad; a handle having a proximal end and a distal end, wherein the proximal end of the handle is coupled to the proximal end of the suspension strap and distal end of the handle is coupled to the distal end of the suspension strap; a member having a first surface, a second surface, a proximal end, and a distal end, and wherein the first surface of the member at the proximal end is coupled to the handle.

In one embodiment, the proximal end of the adjustable retaining harness includes a first loop configured to wrap around a first shoulder and a first arm pit of a user. In one embodiment, the first loop further includes a second shoulder pad. In one embodiment, the first loop includes one or more first break points. In one embodiment, the one or more first break points are located about halfway in the first loop. In one embodiment, the one or more first break points include a precut adjustable retaining harness having a first end and a second end that are coupled together. In one embodiment, the one or more first break points include a precut adjustable retaining harness having a first end and a second end that are coupled together with a first fabric. In one embodiment, the first fabric has a breaking strength about 25 pounds of force.

In one embodiment, the first shoulder pad includes a belt buckle on the first surface coupled with one or more first apertures and wherein the first shoulder pad includes one or more second apertures. In one embodiment, the suspension strap is coupled to the first shoulder pad with the one or more second apertures. In one embodiment, the adjustable retaining harness includes an elastic material. In one embodiment, the suspension strap includes an elastic material. In one embodiment, the suspension strap is adjustable. In one embodiment, the suspension strap is an adjustable elastic suspension strap.

In one embodiment, the suspension strap includes one or more second break points. In one embodiment, the one or more second break points are located about half way between the proximal end and the distal end of the suspension strap. In one embodiment, the one or more second break points include a precut adjustable elastic suspension strap having a first end and a second end, and wherein the first end and the second end are coupled together. In one embodiment, the one or more second break points include a precut adjustable elastic suspension strap having a first end and a second end, and wherein the first end and the second end are coupled together with a second fabric.

In one embodiment, the second fabric has a breaking strength from about 25 pounds of force to about 85 pounds of force.

In one embodiment, the handle is coupled through a second loop at the proximal end of the suspension strap and through a third loop at the distal end of the suspension strap. In one embodiment, the second loop and the third loop each independently include one or more non-elastic materials. In one embodiment, the proximal end of the handle is coupled to a first end cap. In one embodiment, the first end cap is a first screw end cap. In one embodiment, the distal end of the handle is coupled to a second end cap. In one embodiment, the second end cap is a second screw end cap.

In one embodiment, the first surface of the member at the distal end is coupled to a wedge. In one embodiment, the wedge includes an elastic material. In one embodiment, the wherein the wedge includes one or more sewn folds of the member.

The present invention provides a load conveyance system. The load conveyance system includes: an adjustable retaining harness having a proximal end and a distal end, wherein the proximal end of the adjustable retaining harness includes a first loop configured to wrap around a first shoulder and a first arm pit of a user, wherein the distal end includes one or more first apertures; a first shoulder pad having a first surface, a second surface, a proximal end, and a distal end, wherein the first shoulder pad includes: a belt buckle on the first surface coupled to the one or more first apertures, and one or more second apertures; a suspension strap having a proximal end and a distal end, wherein the suspension strap is coupled with the one or more second apertures; a handle having a proximal end and a distal end, wherein the handle is coupled through a second loop at the proximal end of the suspension strap and through a third loop at the distal end of the suspension strap, wherein the proximal end of the handle is coupled to a first end cap, wherein the distal end of the handle is coupled to a second end cap; and a member having a first surface, a second surface, a proximal end, and a distal end, wherein the first surface of the member at the proximal end is coupled to the handle, and wherein the first surface of the member at the distal end is coupled to a wedge.

In one embodiment, the adjustable retaining harness includes an elastic material. In one embodiment, the first loop further includes a second shoulder pad. In one embodiment, the first loop includes one or more first break points. In one embodiment, the one or more first break points are located about halfway in the first loop. In one embodiment, the one or more first break points include a precut adjustable retaining harness having a first end and a second end that are coupled together. In one embodiment, the one or more first break points include a precut adjustable retaining harness having a first end and a second end that are coupled together with a first fabric. In one embodiment, the first fabric has a breaking strength about 25 pounds of force. In one embodiment, the suspension strap includes an elastic material.

In one embodiment, the suspension strap is adjustable. In one embodiment, the suspension strap is an adjustable elastic suspension strap. In one embodiment, the suspension strap includes one or more second break points. In one embodiment, the one or more second break points are located about half way between the proximal end and the distal end of the suspension strap. In one embodiment, the one or more second break points include a precut adjustable elastic suspension strap having a first end and a second end and wherein the first end and the second end are coupled together. In one embodiment, the one or more second break points include a precut adjustable elastic suspension strap having a first end and a second end, and wherein the first end and the second end are coupled together with a second fabric.

In one embodiment, the second fabric has a breaking strength from about 25 pounds of force to about 85 pounds of force. In one embodiment, the second loop and the third loop each independently include one or more non-elastic materials.

In one embodiment, the first end cap is a first screw end cap. In one embodiment, the second end cap is a second screw end cap. In one embodiment, the wedge includes an elastic material. In one embodiment, the wedge includes one or more sewn folds of the member.

The present invention provides a load conveyance system. The load conveyance system includes: an adjustable retaining harness having a proximal end and a distal end, wherein the proximal end of the adjustable retaining harness includes a first loop configured to wrap around a first shoulder and a first arm pit of a user, wherein the distal end includes one or more first apertures; a first shoulder pad having a first surface, a second surface, a proximal end, and a distal end, wherein the first shoulder pad includes: a belt buckle on the first surface coupled to the one or more first apertures, and one or more second apertures; an adjustable elastic suspension strap having a proximal end and a distal end, wherein the adjustable elastic suspension strap is coupled with the one or more second apertures; a handle having a proximal end and a distal end, wherein the handle is coupled through a second loop at the proximal end of the adjustable elastic suspension strap and through a third loop at the distal end to the adjustable elastic suspension strap, wherein the proximal end of the handle is coupled to a first end cap, wherein the distal end of the handle is coupled to a second end cap; a member having a first surface, a second surface, a proximal end, and a distal end, wherein the first surface of the member at the proximal end is coupled to the handle, and wherein the first surface of the member at the distal end is coupled to a wedge.

In one embodiment, the first loop further includes a second shoulder pad. In one embodiment, the first loop includes one or more first break points. In one embodiment, the one or more first break points are located about halfway in the first loop. In one embodiment, the one or more first break points include a precut adjustable retaining harness having a first end and a second end that are coupled together. In one embodiment, the one or more first break points include a precut adjustable retaining harness having a first end and a second end that are coupled together with a first fabric. In one embodiment, the first fabric has a breaking strength about 25 pounds of force.

In one embodiment, the adjustable elastic suspension strap includes one or more second break points. In one embodiment, the one or more second break points are located about half way between the proximal end and the distal end of the adjustable elastic suspension strap. In one embodiment, the one or more second break points include a precut adjustable elastic suspension strap having a first end and a second end, and wherein the first end and the second end are coupled together. In one embodiment, the one or more second break points include a precut adjustable elastic suspension strap having a first end and a second end, and wherein the first end and the second end are coupled together with a second fabric. In one embodiment, the second fabric has a breaking strength from about 25 pounds of force to about 85 pounds of force.

In one embodiment, the first end cap is a first screw end cap. In one embodiment, the second end cap is a second screw end cap. In one embodiment, the wedge includes an elastic material. In one embodiment, the wedge includes one or more sewn folds of the member. In one embodiment, the second loop and the third loop each independently include one or more non-elastic materials.

BRIEF DESCRIPTION OF THE DRAWINGS

Embodiments of the invention may be best understood by referring to the following description and accompanying drawings, which illustrate such embodiments.

In the drawings.

Figure 1:
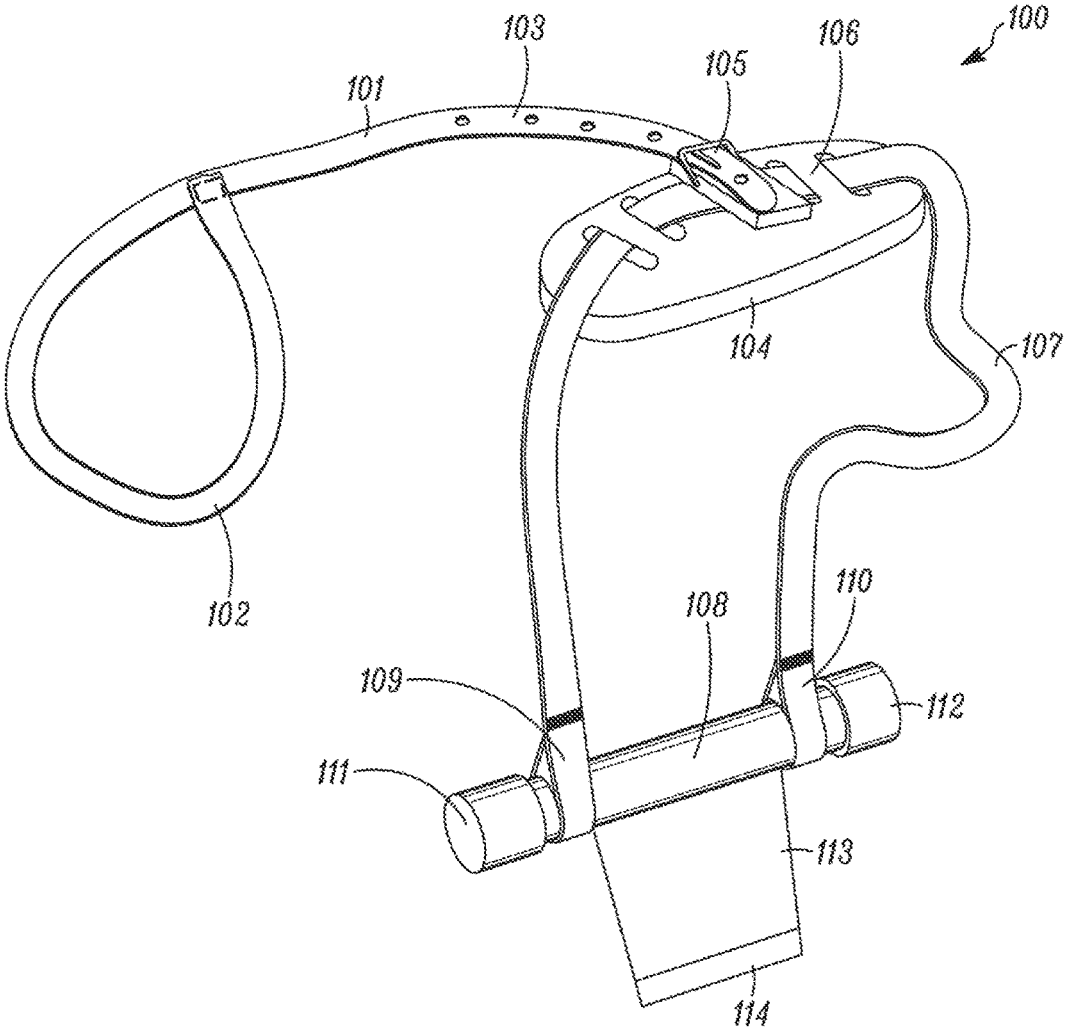
FIG. 1 is a perspective drawing illustrating an exemplary load conveyance system.

The drawings are not necessarily to scale. Like numbers used in the figures refer to like components, steps, and the like. However, it will be understood that the use of a number to refer to a component in a given figure is not intended to limit the component in another figure labeled with the same number.

DETAILED DESCRIPTION OF THE INVENTION

The present invention provides a load conveyance system. The load conveyance system includes: an adjustable retaining harness that fits around a user's shoulder and arm; a first shoulder pad that fits on the user's other shoulder; a suspension strap; a handle, and a member. Methods of using the load conveyance system are also disclosed.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the claims made herein.

Methods recited herein may be carried out in any order of the recited events which is logically possible, as well as the recited order of events. Furthermore, where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

The referenced items are provided solely for their disclosure prior to the filing date of the present application. Nothing herein is to be construed as an admission that the present invention is not entitled to antedate such material by virtue of prior invention.

Unless otherwise indicated, the words and phrases presented in this document have their ordinary meanings to one of skill in the art. Such ordinary meanings can be obtained by reference to their use in the art and by reference to general and scientific dictionaries, for example, *Webster's Third New International Dictionary*, Merriam-Webster Inc., Springfield, M A, 1993 and *The American Heritage Dictionary of the English Language*, Houghton Mifflin, Boston Mass., 1981.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "about" refers to a variation of 10 percent of the value specified; for example, about 50 percent carries a variation from 45 to 55 percent.

As used herein, the term "and/or" refers to any one of the items, any combination of the items, or all of the items with which this term is associated.

As used herein, the singular forms "a," "an," and "the" include plural reference unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation.

As used herein, the term "comprising" or "comprises" is intended to mean that the compositions and methods include the recited elements, but not excluding others.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the term "load" refers to any object, typically, soft and hard-shell suitcases, duffel bags, golf bags, ski bags, trunks, chests, shipping containers, stretchers, gurneys, canisters, boxes, and the like.

As used herein, the phrase "operatively coupled" refers to bringing two or more items together or into relationship with each other such that they may operate together or allow transfer of information between the two or more items.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the term "proximal" refers to the closest end of an object. In contrast, the term "distal" refers to the farthest end of an object.

As used herein, the terms "front," "back," "rear," "upper," "lower," "right," and "left" in this description are merely used to identify the various elements as they are oriented in the FIGS. with "front," "back," and "rear" being relative apparatus. These terms are not meant to limit the element which they describe, as the various elements may be oriented differently in various applications.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

The invention illustratively disclosed herein suitably may be practiced in the absence of any element which is not specifically disclosed herein.

Figure 2:
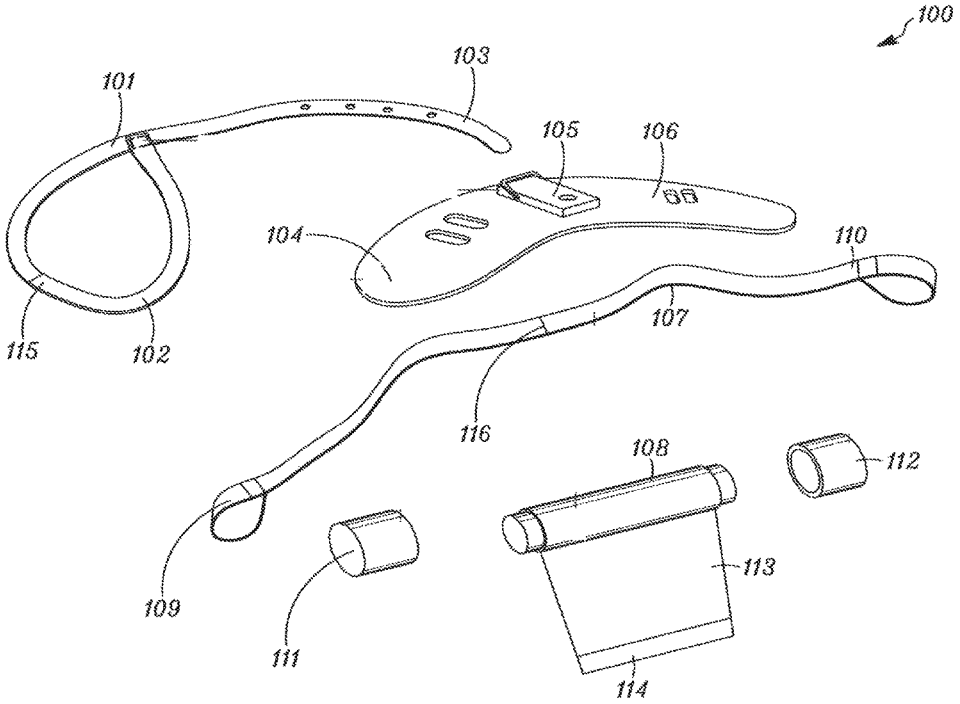
FIG. 2 is a perspective drawing illustrating the various components of an exemplary load conveyance system.

FIGS. 1-2 are perspective drawings illustrating an exemplary load conveyance system 100 and the components. The load conveyance system 100 includes: an adjustable retaining harness 101 that fits around a user's shoulder and arm; a first shoulder pad 104 that fits on the user's other shoulder; a suspension strap 107; a handle 108, and a member 113. The adjustable retaining harness 101 has proximal end and a distal end. The proximal end includes a first loop 102 that is configured to wrap around a first shoulder and a first arm pit of a user (not shown). The distal end comprises one or more first apertures 103. The first shoulder pad 104 has a first surface, a second surface, a proximal end, and a distal end, and includes a belt buckle 105 on the first surface coupled to the one or more first apertures 103, and one or more second apertures 106. The suspension strap 107 has a proximal end and a distal end and is coupled with the one or more second apertures 106. The handle 108 has a proximal end and a distal end and is coupled through a second loop 109 at the proximal end of the suspension strap 107 and through a third loop 110 at the distal end of the suspension strap 107. The proximal end of the handle 108 is coupled to a first end cap 111. The distal end of the handle 108 is coupled to a second end cap 112. The member 113 has a first surface, a second surface, a proximal end, and a distal end. The first surface of the member 113 at the proximal end is coupled to the handle 108. The first surface of the member 113 at the distal end is coupled to a wedge 114.

In one embodiment, the adjustable retaining harness 101 is an elastic material. In one embodiment, the first loop 102 may include a second shoulder pad (not shown) that rests upon the user's other shoulder thereby transferring some of the load of the first loop 102 from the user's arm (not shown) and armpit (not shown). In one embodiment, the first loop 102 may include one or more first break points 115. In one embodiment, the one or more first break points 115 may be located about halfway in the first loop 102. The one or more first break points 115 may be a precut adjustable retaining harness 102 that has a first end and a second end. The first end and the second end are coupled together. The suspension strap 107 may include an elastic material. The suspension strap 107 may be adjustable. The suspension strap 107 may be an adjustable elastic suspension strap.

The suspension strap 107 may include one or more second break points 116, which are located about half way between the proximal end and the distal end of the suspension strap 107. The one or more second break points 116 may be a precut suspension strap 10 that has a first end and a second end coupled together. The second loop 109 and the third loop 110 each independently may be one or more non-elastic materials. The first end cap 111 may be a first screw end cap. The second end cap 112 may be a second screw end cap. The wedge 114 may include an elastic material that is coupled to the member 113. The wedge 114 may also include one or more sewn folds (not shown) of the member 113.

Figure 3:
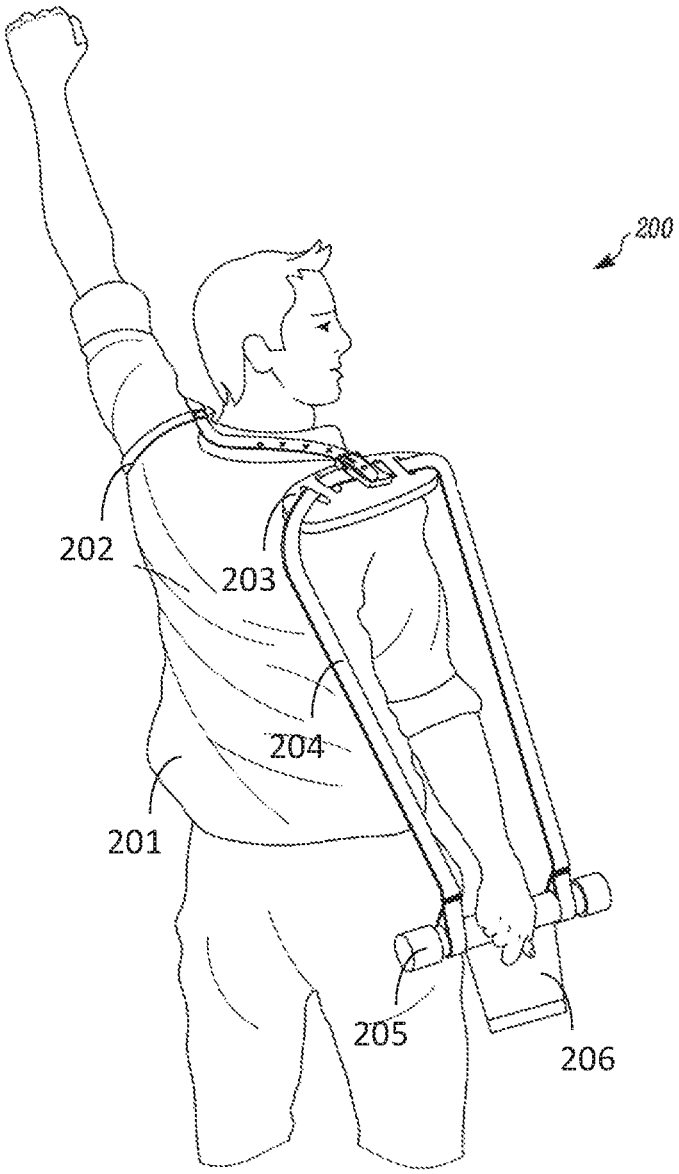
FIG. 3 is a perspective drawing illustrating an exemplary load conveyance system on user.

FIG. 3 is a perspective drawing illustrating an exemplary load conveyance system 200 on user 201. The adjustable retaining harness 202 fits around a user's shoulder and arm and is coupled to the first shoulder pad 203 that fits on the user's other shoulder. The shoulder pad 203 supports a suspension strap 204, a handle 205, and a member 206 that is gripped by the user 201. The user 201 wraps the member 206 around the luggage handle (not shown) to efficiently lift and carry the luggage (not shown)

Figure 4:
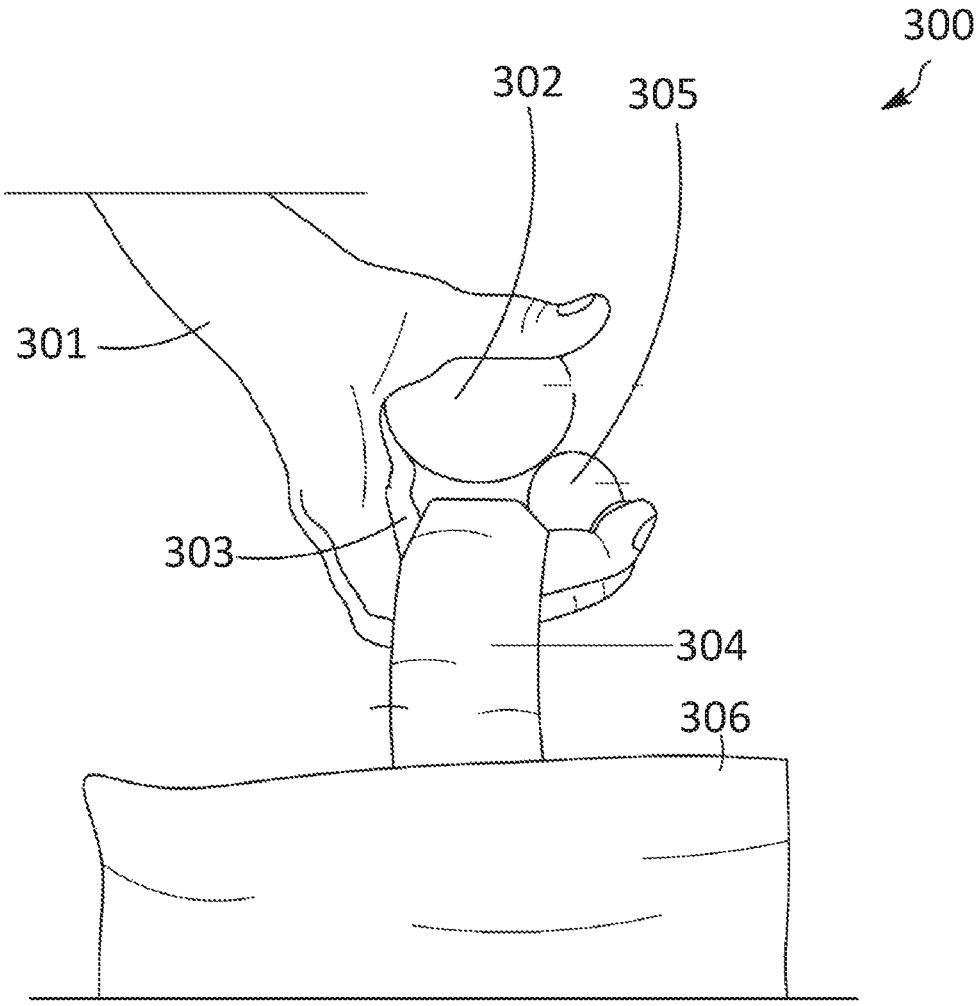
FIG. 4 is a side-view drawing illustrating the handle system of an exemplary load conveyance system.

FIG. 4 is a side-view drawing illustrating the handle system 300 of an exemplary load conveyance system. The user 301 grips the handle 302 and wraps the member 303 around the luggage handle 304. The user 301 presses the wedge 305 firmly against the handle 302 to efficiently lift and carry the luggage 306.

In the claims provided herein, the steps specified to be taken in a claimed method or process may be carried out in any order without departing from the principles of the invention, except when a temporal or operational sequence is explicitly defined by claim language. Recitation in a claim to the effect that first a step is performed then several other steps are performed shall be taken to mean that the first step is performed before any of the other steps, but the other steps may be performed in any sequence unless a sequence is further specified within the other steps. For example, claim elements that recite "first A, then B, C, and D, and lastly E" shall be construed to mean step A must be first, step E must be last, but steps B, C, and D may be carried out in any sequence between steps A and E and the process of that sequence will still fall within the four corners of the claim.

Furthermore, in the claims provided herein, specified steps may be carried out concurrently unless explicit claim language requires that they be carried out separately or as parts of different processing operations. For example, a claimed step of doing X and a claimed step of doing Y may be conducted simultaneously within a single operation, and the resulting process will be covered by the claim. Thus, a step of doing X, a step of doing Y, and a step of doing Z may be conducted simultaneously within a single process step, or in two separate process steps, or in three separate process steps, and that process will still fall within the four corners of a claim that recites those three steps.

Similarly, except as explicitly required by claim language, a single substance or component may meet more than a single functional requirement, provided that the single substance or component fulfills the more than one functional requirement as specified by claim language.

All patents, patent applications, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Additionally, all claims in this application, and all priority applications, including but not limited to original claims, are hereby incorporated in their entirety into, and form a part of, the written description of the invention.

Applicant reserves the right to physically incorporate into this specification any and all materials and information from any such patents, applications, publications, scientific articles, web sites, electronically available information, and other referenced materials or documents. Applicant reserves the right to physically incorporate into any part of this document, including any part of the written description, the claims referred to above including but not limited to any original claims.

What is claimed is:

1. A load conveyance system comprising:

an adjustable retaining harness having a proximal end and a distal end, wherein the proximal end of the adjustable retaining harness is configured to wrap around a first shoulder and a first arm pit of a user;

a first shoulder pad having a first surface, a second surface, a proximal end, and a distal end, wherein the first shoulder pad comprises a belt buckle on the first surface coupled with one or more first apertures and wherein the suspension strap is coupled to the first shoulder pad with one or more second apertures, wherein the first surface of the first shoulder pad is coupled with the distal end of the adjustable retaining harness;

a suspension strap having a proximal end and a distal end, wherein the suspension strap is coupled with the first surface of the first shoulder pad;

a handle having a proximal end and a distal end, wherein the proximal end of the handle is coupled to the proximal end of the suspension strap and the distal end of the handle is coupled to the distal end of the suspension strap;

a member having a first surface, a second surface, a proximal end, and a distal end, and wherein the first surface of the member at the proximal end is coupled to the handle.

2. A load conveyance system comprising:

an adjustable retaining harness having a proximal end and a distal end, wherein the proximal end of the adjustable retaining harness comprises a first loop configured to wrap around a first shoulder and a first arm pit of a user, wherein the distal end comprises one or more first apertures;

a first shoulder pad having a first surface, a second surface, a proximal end, and a distal end, wherein the first shoulder pad comprises: a belt buckle on the first surface coupled to the one or more first apertures, and one or more second apertures;

a suspension strap having a proximal end and a distal end, wherein the suspension strap is coupled with the one or more second apertures;

a handle having a proximal end and a distal end, wherein the handle is coupled through a second loop at the proximal end of the suspension strap and through a third loop at the distal end of the suspension strap, wherein the proximal end of the handle is coupled to a first end cap, wherein the distal end of the handle is coupled to a second end cap; and a member having a first surface, a second surface, a proximal end, and a distal end, wherein the first surface of the member at the proximal end is coupled to the handle, and wherein the first surface of the member at the distal end is coupled to a wedge.

3. The load conveyance system of claim 2, wherein the first loop comprises one or more first break points each independently comprising a precut adjustable retaining harness having a first end and a second end that are coupled together.

4. The load conveyance system of claim 2, wherein the suspension strap comprises one or more second break points each independently comprising a precut adjustable elastic suspension strap having a first end and a second end, and wherein the first end and the second end are coupled together.

5. The load conveyance system of claim 2, wherein the wedge comprises an elastic material.

6. The load conveyance system of claim 2, wherein the wedge comprises one or more sewn folds of the member.

7. A load conveyance system comprising:

an adjustable retaining harness having a proximal end and a distal end, wherein the proximal end of the adjustable retaining harness comprises a first loop configured to wrap around a first shoulder and a first arm pit of a user, wherein the distal end comprises one or more first apertures;

a first shoulder pad having a first surface, a second surface, a proximal end, and a distal end, wherein the first shoulder pad comprises:

a belt buckle on the first surface coupled to the one or more first apertures, and one or more second apertures;

an adjustable elastic suspension strap having a proximal end and a distal end, wherein the adjustable elastic suspension strap is coupled with the one or more second apertures;

a handle having a proximal end and a distal end, wherein the handle is coupled through a second loop at the proximal end of the adjustable elastic suspension strap and through a third loop at the distal end to the adjustable elastic suspension strap, wherein the proximal end of the handle is coupled to a first end cap, wherein the distal end of the handle is coupled to a second end cap;

a member having a first surface, a second surface, a proximal end, and a distal end, wherein the first surface of the member at the proximal end is coupled to the handle, and wherein the first surface of the member at the distal end is coupled to a wedge.

8. The load conveyance system of claim 7, wherein the first loop comprises one or more first break points each independently comprising a precut adjustable retaining harness having a first end and a second end that are coupled together with a first fabric having a breaking strength of 25 pounds of force.

9. The load conveyance system of claim 7, wherein the adjustable elastic suspension strap comprises one or more second break points each independently comprising a precut adjustable elastic suspension strap having a first end and a second end, and wherein the first end and the second end are coupled together with a second fabric having a breaking strength from 25 pounds of force to 85 pounds of force.

10. The load conveyance system of claim 7, wherein the first end cap is a first screw end cap.

11. The load conveyance system of claim 7, wherein the second end cap is a second screw end cap.

12. The load conveyance system of claim 7, wherein the wedge comprises an elastic material.

13. The load conveyance system of claim 7, wherein the wedge comprises one or more sewn folds of the member.

* * * * *